US005162761A

United States Patent [19]

Kita et al.

[11] Patent Number: 5,162,761

[45] Date of Patent: Nov. 10, 1992

[54] MICROWAVE STRIPLINE RESONATOR INCLUDING A DIELECTRIC SUBSTRATE HAVING A DEPRESSION

[75] Inventors: Masaki Kita, Kyoto; Kimio Aizawa, Ikoma, both of Japan

[73] Assignee: Matsushita Electric Industrial Co., Ltd., Osaka, Japan

[21] Appl. No.: 727,417

[22] Filed: Jul. 9, 1991

[30] Foreign Application Priority Data

Jul. 9, 1990 [JP] Japan ..... 2-180839

[51] Int. Cl.[5] ..... H01P 1/203; H01P 7/08

[52] U.S. Cl. ..... 333/219; 333/204

[58] Field of Search ..... 333/202, 204, 205, 219, 333/238, 246

[56] References Cited

U.S. PATENT DOCUMENTS 4,266,206 5/1981 Bedard et al. ..... 333/204

4,785,271 11/1988 Higgins, Jr. ..... 333/219 X

FOREIGN PATENT DOCUMENTS 0161802 7/1986 Japan ..... 333/204

*Primary Examiner*—Eugene R. LaRoche

*Assistant Examiner*—Seung Ham

*Attorney, Agent, or Firm*—Ratner & Prestia

[57] ABSTRACT

This invention relates to a compact and high performance microwave stripline resonator consisting of a dielectric substrate provided with a strip electrode and a depression coated with an electrode which is connected to an end of the strip electrode provided on one of the surfaces of the dielectric substrate and a grounding electrode provided on the other surface of the dielectric substrate, and the grounding electrode is connected to the other end of said strip electrode. With this dielectric resonator construction, the characteristic impedance of the strip electrode and the characteristic impedance of the electrode coated on the depression are made different. As a result of this, the length of microwave stripline can be shortened without sacrificing the Q of the resonator. This is highly effective to realize compact resonators.

3 Claims, 2 Drawing Sheets

MICROWAVE STRIPLINE RESONATOR INCLUDING A DIELECTRIC SUBSTRATE HAVING A DEPRESSION

FIELD OF THE INVENTION

This invention relates to microwave stripline resonators employed in mobile communication equipment such as mobile telephones. In particular, a compact and high performance microwave stripline resonator is disclosed.

BACKGROUND OF THE INVENTION

As shown in FIG. 5, a conventional microwave stripline resonator consists of a strip electrode 6B provided on a surface of dielectric substrate 1 and a grounding electrode 3 provided on adjacent surfaces of dielectric substrate 1. The strip electrode and the grounding electrode are interconnected.

With such a construction of conventional resonator, the length of strip electrode 6B is exclusively determined by its resonant frequency. Therefore, the employment of dielectric substrate 1 having a large dielectric constant is desirable to make the resonator more compact.

However, a dielectric substrate having a large dielectric constant is generally associated with a lower no-load Q and an irregular flatness of temperature coefficient characteristics. Thus, a dielectric substrate having a large dielectric constant exhibits poor resonator characteristics.

SUMMARY OF THE INVENTION

The present invention solves the problems associated with conventional stripline resonators, while offering compact and high-performance microwave stripline resonators.

A microwave stripline resonator in accordance with the present invention consists of a rectangular dielectric substrate, a strip electrode provided on a first surface of the dielectric substrate, a depression in the first surface of the dielectric substrate, an electrode coating the depression wherein the electrode is connected to a first end of the strip electrode, and a grounding electrode provided on a second surface of the dielectric substrate wherein the grounding electrode is connected to a second end of the strip electrode.

With this dielectric resonator construction, the characteristic impedance of the strip electrode and the characteristic impedance of the electrode which is coated on the depression are made different. As a result of this, the length of the microwave stripline can be shortened without sacrificing the Q of the resonator. This is highly effective to realize compact resonators.

BRIEF DESCRIPTION OF THE DRAWINGS

For a more complete understanding of the nature, features and advantages of the present invention, provided below is a detailed description of exemplary illustrative embodiments of the invention, which are illustrated by and best understood with references to the accompanying drawings wherein.

DESCRIPTION OF THE PREFERRED EMBODIMENTS

Figure 1A:
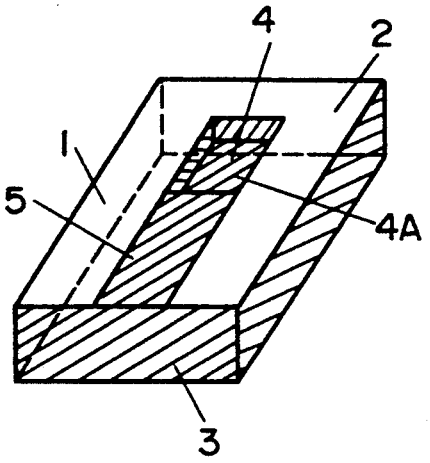
FIGS. 1(*a*) and 1(*b*) show perspective and cross-sectional schematic views, respectively, of an embodiment of the invention.
Figure 1B:
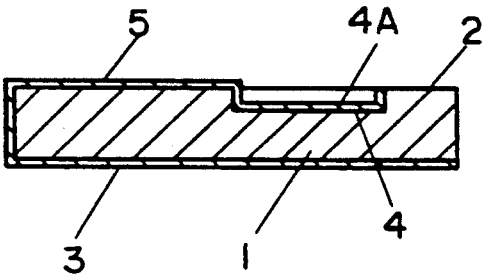

As shown in FIG. 1, in which one of the embodiments of the present invention is illustrated, adjacent surfaces of a rectangular dielectric substrate 1 are covered by a grounding electrode 3. A surface of dielectric substrate 1 is provided with a depression 4 which is covered by electrode 4A. Electrode 4A is connected to grounding electrode 3 through strip electrode 5. Strip electrode 5 has a width identical to that of electrode 4A.

With this stripline resonator construction, the total length of strip electrode 5 and electrode 4A covering depression 4 can be substantially shorter than the length of a stripline electrode of a conventional microwave stripline resonator.

Figure 2:
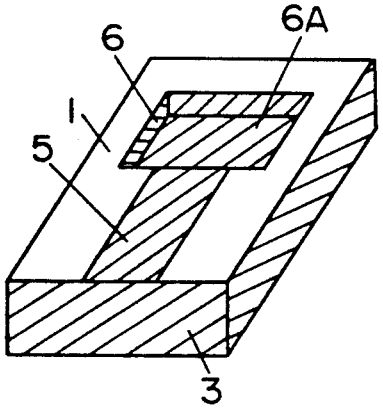
FIG. 2 shows a perspective schematic view of a microwave stripline resonator in accordance with a further embodiment of the invention.

FIG. 2 shows another embodiment of the present invention, where the electrode length is made still shorter than that of the microwave stripline resonator shown in FIG. 1. This is accomplished by employing an electrode 6A which covers depression 4. Electrode 6A has a wider width than that of strip electrode 5 provided on the surface of dielectric substrate 1.

Figure 3:
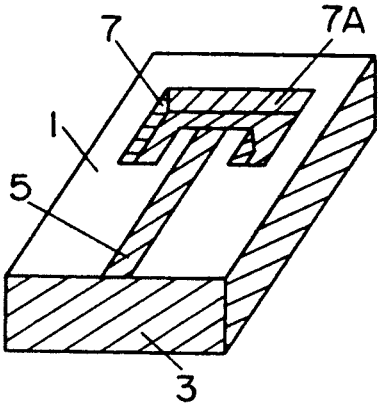
FIG. 3 shows a perspective schematic view of a microwave stripline resonator in accordance with a still further embodiment of the invention.

FIG. 3 shows still another embodiment of the present invention providing a depression 7 which is covered by electrode 7A with a U-shaped opening partly accommodating strip electrode 5.

Figure 4:
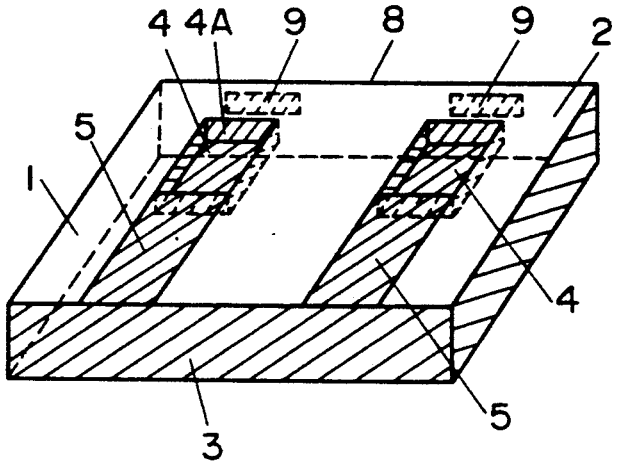
FIG. 4 shows a perspective schematic view of a filter device employing a microwave stripline resonator of the present invention.
Figure 5:
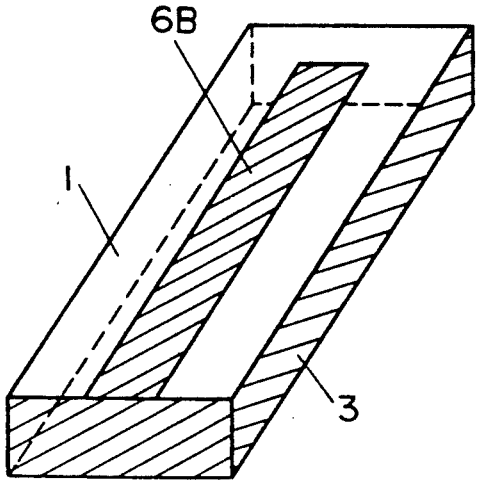
FIG.5 PRIOR ART
FIG. 5 shows a perspective view of a conventional microwave stripline resonator.

A filter device, employing the microwave stripline resonator shown in FIG. 1, is illustrated in FIG. 4 wherein adjacent surfaces of rectangular dielectric substrate 1 (not including surface 2) are covered by grounding electrode 3 by means of metallization or such, and two rectangular depressions 4 are provided on surface 2 of dielectric substrate 1.

Electrodes 4A covering depressions 4 are connected to grounding electrode 3. Signal output electrodes 9 are also provided on regions corresponding to depressions 4 on the rear side 8 of dielectric substrate 1.

According to the resonator construction of the present invention, a compact and high-performance microwave stripline resonator can be realized by providing depressions covered by electrodes and strip electrodes connected thereto on a dielectric substrate.

What we claim are:

1. A microwave stripline resonator comprising:

a dielectric substrate having a depression;

a resonator electrode comprising:

a) a strip electrode provided on a first surface of said dielectric substrate; and b) an electrode coating said depression and connected to a first end of said strip electrode; and a grounding electrode provided on a second surface of said dielectric substrate, wherein said grounding electrode is connected to a second end of said strip electrode.

2. A microwave stripline resonator according to claim 1, wherein said depression and said strip electrode each have a length and a width, said length of said strip electrode and said length of said depression each extending from said first end of said strip electrode, and wherein the width of said depression is wider than the width of said strip electrode.

3. A microwave stripline resonator according to claims 1 or 2, wherein said depression is U-shaped.

* * * * *